US007775351B2

(12) United States Patent
Stagnitta et al.

(10) Patent No.: US 7,775,351 B2
(45) Date of Patent: Aug. 17, 2010

(54) SYSTEM AND METHOD FOR PACKAGING APPAREL

(75) Inventors: Gregory V. Stagnitta, Nazareth, PA (US); Joseph M. Brucato, Clemmons, NC (US); Robert A. Miller, III, New Ringgold, PA (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 1060 days.

(21) Appl. No.: 10/857,649

(22) Filed: May 28, 2004

(65) Prior Publication Data

US 2005/0263415 A1 Dec. 1, 2005

(51) Int. Cl.
*B65D 85/18* (2006.01)

(52) U.S. Cl. ..... 206/278; 206/497

(58) Field of Classification Search ..... 206/278–299, 206/497; 229/87.15, 87.16, 87.17
See application file for complete search history.

(56) References Cited

U.S. PATENT DOCUMENTS 1,434,279 A * 10/1922 Baum ..... 434/396
1,616,181 A * 2/1927 Freedman ..... 206/731
1,734,621 A * 11/1929 Goldberg ..... 206/766
1,942,673 A * 1/1934 Weiner ..... 206/577
2,808,194 A * 10/1957 Dols ..... 229/116.5
3,256,976 A * 6/1966 Greason ..... 206/278
3,625,348 A * 12/1971 Titchenal et al. ..... 206/484
3,958,392 A 5/1976 Beninger
4,163,353 A 8/1979 Finn et al.
4,235,063 A 11/1980 Paetz
4,240,193 A 12/1980 Krein
4,272,874 A 6/1981 Krein
4,318,264 A 3/1982 Rewitzer
4,372,101 A 2/1983 Fleissner
4,411,122 A 10/1983 Cornish et al.
4,414,788 A 11/1983 Berg
4,432,188 A 2/1984 Andrews
RE31,944 E 7/1985 Stromberg
4,595,093 A 6/1986 Eckstein
4,660,352 A 4/1987 Deines et al.
4,688,369 A 8/1987 Cornish et al.
4,706,440 A 11/1987 Bittner
4,757,669 A * 7/1988 Areblom et al. ..... 53/512
4,815,253 A 3/1989 Kovacs et al.
4,821,491 A * 4/1989 Rias ..... 53/438
4,924,656 A 5/1990 Kovacs et al.
5,022,216 A 6/1991 Muckenfuhs et al.
5,042,227 A 8/1991 Merry (Continued)

FOREIGN PATENT DOCUMENTS

DE 29610959 10/1996

(Continued)

OTHER PUBLICATIONS

Shrink wrap products, http://www.provincialpaper.com/shrinkwrap.asp.*

*Primary Examiner*—Tri M Mai
(74) *Attorney, Agent, or Firm*—Womble Carlyle Sandridge & Rice, PLLC

(57) ABSTRACT

A package containing a plurality of articles of textile products, comprising one or more compacted articles and at least one un-compacted article. The un-compacted article is placed so that it is predominantly visible.

7 Claims, 6 Drawing Sheets

U.S. PATENT DOCUMENTS 5,125,210 A 6/1992 Lang et al.
5,131,210 A 7/1992 Kiya
5,136,825 A 8/1992 White, Jr.
5,150,561 A 9/1992 Muckenfuhs
5,172,629 A 12/1992 Merry
5,177,938 A 1/1993 Mayersbeth
5,224,324 A 7/1993 Granfelt
5,309,828 A 5/1994 Merry
5,406,774 A 4/1995 Dodge
5,417,912 A 5/1995 Merry
5,437,144 A 8/1995 Akiyama et al.
5,447,012 A 9/1995 Kovacs et al.
5,485,919 A * 1/1996 Samberg et al. ..... 206/461
5,524,531 A 6/1996 Merry
5,603,284 A 2/1997 Freedman
5,622,030 A 4/1997 Steed et al.
5,692,606 A 12/1997 Merry
5,735,106 A 4/1998 Burda et al.
5,788,130 A 8/1998 Todd et al.
5,800,766 A 9/1998 Merry
5,813,538 A 9/1998 Kaufman
5,816,142 A 10/1998 Keller et al.
5,832,696 A 11/1998 Nagy et al.
5,870,885 A 2/1999 Biddle et al.
RE36,142 E 3/1999 Steed et al.
5,878,551 A 3/1999 Curley et al.
5,930,983 A 8/1999 Terminella et al.
5,947,366 A * 9/1999 Feldmann et al. ..... 229/87.17
5,971,153 A 10/1999 Bauer et al.
5,979,145 A 11/1999 Louis et al.
5,996,320 A 12/1999 Todd et al.
6,021,626 A 2/2000 Goodman
6,024,224 A * 2/2000 Gnadt et al. ..... 206/763
6,155,028 A 12/2000 Nagata et al.
6,241,084 B1 * 6/2001 Gyr ..... 206/278
6,321,511 B1 11/2001 O'Connor et al.
6,357,210 B1 3/2002 Wetter
6,381,925 B2 5/2002 Rejcek et al.
6,499,574 B1 * 12/2002 Anthony ..... 190/36
6,622,857 B2 9/2003 Ohtsubo et al.
6,637,177 B1 10/2003 Trillich et al.
6,668,522 B2 12/2003 Prakken
6,687,918 B1 2/2004 Hooks et al.

FOREIGN PATENT DOCUMENTS

DE 29615241 11/1996
DE 29716438 12/1997
EP 0705760 B1 3/1999
JP 2002-332083 * 11/2002
LU 33062 8/1954

* cited by examiner

SYSTEM AND METHOD FOR PACKAGING APPAREL

FIELD OF THE INVENTION

The present invention relates generally to the packaging of items of apparel and, more particularly, to a system and method for compactly packaging and merchandising items of apparel.

BACKGROUND OF THE INVENTION

Over the years, retail product manufacturers have sought new ways to compress or compact articles of manufacture for a variety of applications. For example, during the 1960s and 1970s, manufacturers promoted their products and attracted consumers by inserting "free" gifts in their product packages, such as compressed sponges in household cleaning devices, and compacted sponge or rubber toys in breakfast food packages.

In more recent years, retail apparel manufacturers have sought ways to condense or minimize the sizes of apparel packaging. For example, manufacturers have looked for new ways to package apparel items such as underwear and T-shirts, which typically are folded and loosely packaged in bulky display packages. These efforts have been driven by the market and economic/cost variables. Smaller package sizes for apparel translates to less required warehouse storage space. Similarly, reduced volume results in lower freight/shipment costs. Further, smaller compact display packaging means that a larger number of items may be displayed in a limited space at the place of retail sale.

SUMMARY OF THE INVENTION

The present invention is directed to a display package containing a plurality of articles of apparel and a method for forming the display package.

A first aspect of the present invention is directed to the package containing a plurality of items of apparel. In one embodiment, the package comprises a bundle comprising one or more compacted, or compressed, articles of apparel, and at least one un-compacted article of apparel. The un-compacted article of apparel is positioned relative to the compacted articles of apparel so that the un-compacted article is predominantly visible. As used herein, the terms "compacted" and "compressed" are synonymous.

The compacted articles of apparel may be folded and stacked prior to being compacted in a shaped mold, or alternatively, may be randomly and loosely placed into a mold of a desired shape and subsequently compacted at a relatively high pressure. The compacted articles typically will be knitted articles of apparel such as T-shirts, underwear (boxers and briefs), and socks; however, the articles are not limited to apparel, and may comprise any type of textile, or fabric, products that can be compacted. Further, the textile, or fabric, construction is not limited to knitted articles. As will be appreciated, the compacted and un-compacted articles of apparel are of similar type.

Once the compacted bundle is formed, the bundle may be packaged in a shrink-wrap or other suitable lightweight wrapping material.

Since the compacted bundle of articles will likely contain many wrinkles and creases, the un-compacted article, in one embodiment, is folded and positioned on top of the compacted articles of apparel. Alternatively, the un-compacted article of apparel is wrapped around the compacted bundle so as to substantially enclose the compacted articles of apparel.

After positioning the un-compacted article on or around the compacted bundle, the compacted bundle and the un-compacted article are packaged in a bag so that the completed package may be used to display the articles of apparel in a retail setting. To advertise or otherwise indicate the contents of the package, printed indicia, such as labels or cards may be inserted inside the package, or alternatively, may be attached to the outside of the package.

A second aspect of the present invention is directed to a method of packaging a plurality of articles of apparel. One or more articles are first placed in a mold cavity. Again, the articles may be loosely and randomly placed in the mold cavity or folded and stacked in the mold cavity. The articles are then compacted by subjecting them to a predetermined pressure for a predetermined period of time. This is done with a ram or piston which conforms to the shape of the mold. For example, T-shirts, briefs, and boxers are compacted at a high pressure of 3,000 pounds per square inch, or more, for a period of about 1 to 2 seconds. For socks, a pressure of at least 2,000 pounds per square inch is used for a period of about 1 to 2 seconds. The compaction results in a substantially rigid bundle that retains substantially the shape of the mold. The compacted bundle is then removed from the mold. The compacted bundle may then be packaged in a shrink-wrap or other suitable lightweight wrapping material. An un-compacted article is placed relative to the compacted bundle so that the un-compacted article of apparel is predominantly visible when packaged. In one embodiment, the un-compacted article of apparel is folded and placed on top of the compacted bundle. Alternatively, un-compacted article of apparel is wrapped around the compacted bundle so as to substantially enclose the compacted bundle. Lastly, the compacted bundle, which may be shrink-wrapped, and the un-compacted article are packaged in a single package. Conventional bags or wrap are used to enclose the package.

The method may further include the step of including printed indicia either before packaging the compacted bundle and the un-compacted article, or after packaging.

DETAILED DESCRIPTION OF THE PREFERRED EMBODIMENTS

Certain exemplary embodiments of the present invention are described below and illustrated in the attached Figures. The embodiments described are only for purposes of illustrating the present invention and should not be interpreted as limiting the scope of the invention, which, of course, is limited only by the claims below. Other embodiments of the invention, and certain modifications and improvements of the described embodiments, will occur to those skilled in the art, and all such alternate embodiments, modifications and improvements are within the scope of the present invention.

Figure 1:
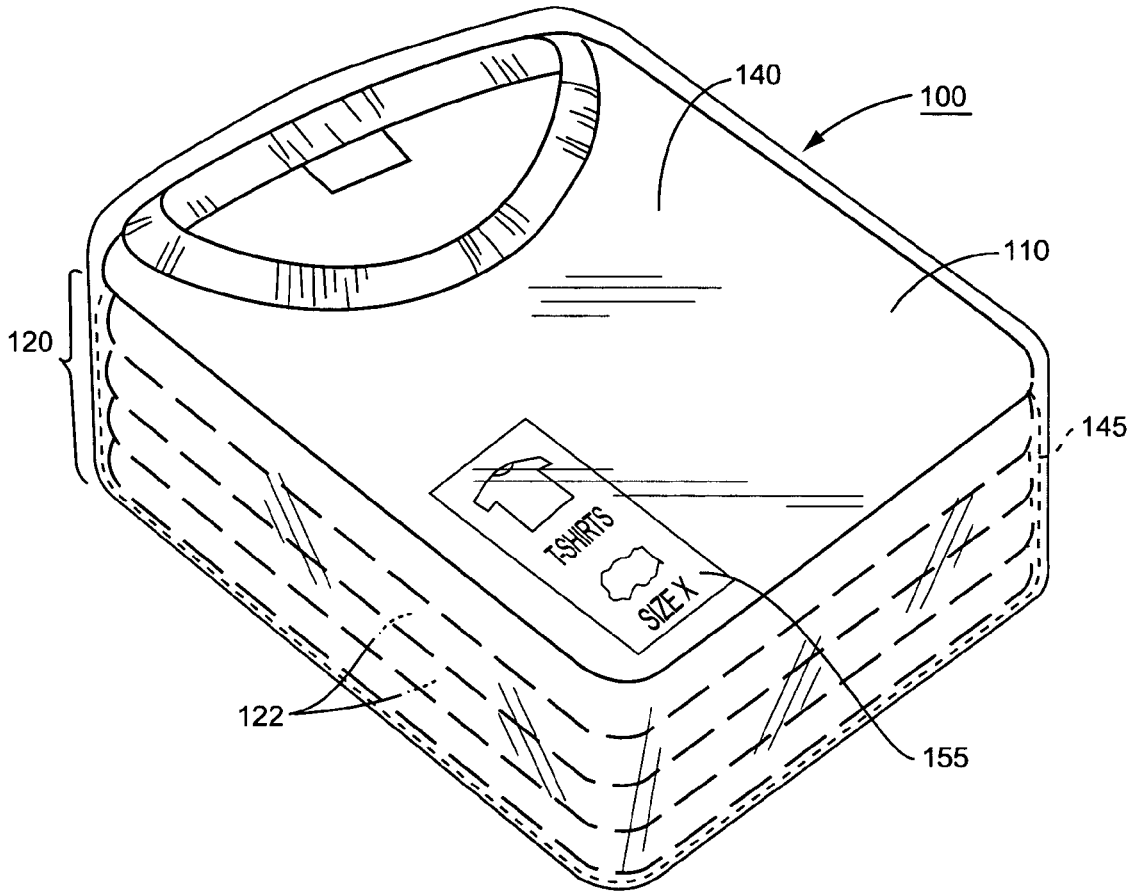
FIG. 1 is a top perspective view of a first embodiment of the display package of the present invention.
Figure 2:
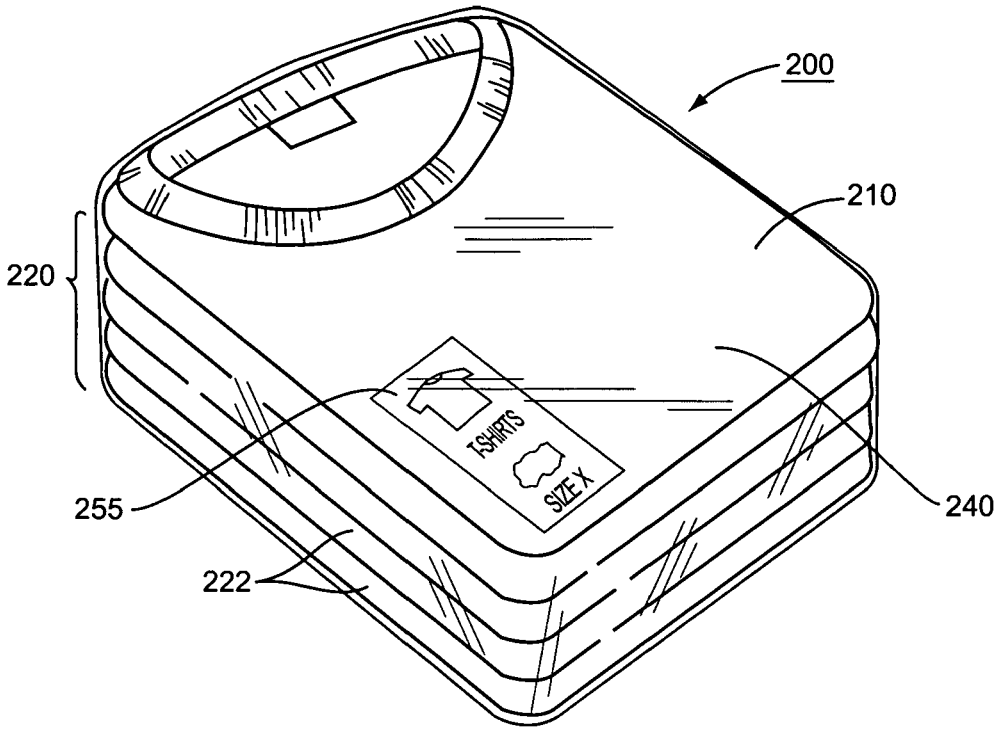
FIG. 2 is a top perspective view of an alternative embodiment of the display package of the present invention.
Figure 3:
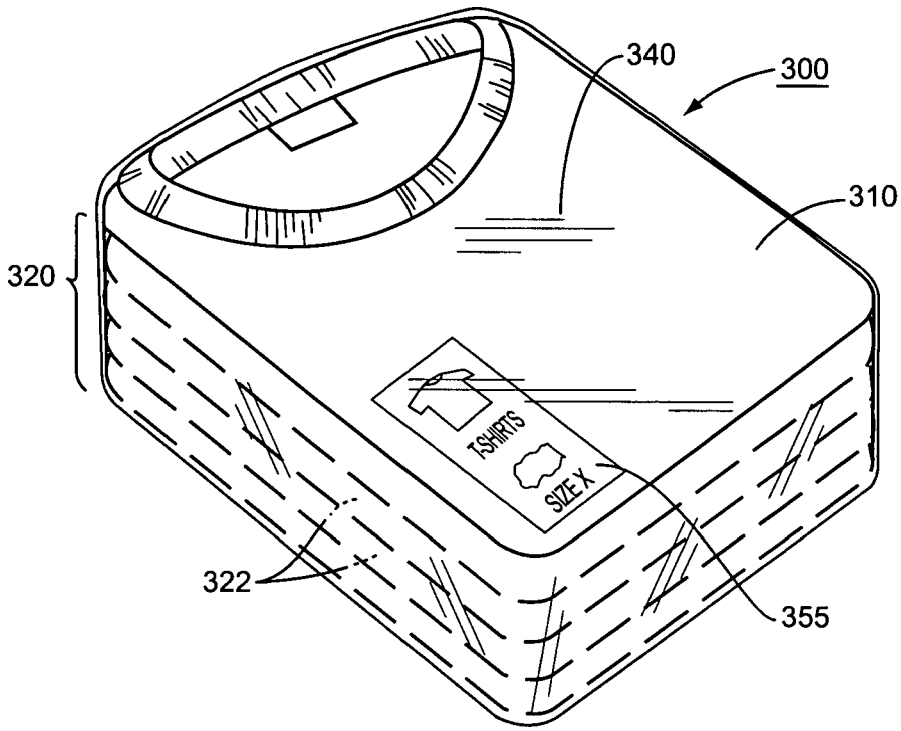
FIG. 3 is a top perspective view of another alternative embodiment of the display package of the present invention.

Referring first to FIGS. 1 through 3, embodiments 100, 200, 300 of the package of the present invention are shown. As shown in FIG. 1, and as explained in greater detail below, embodiment 100 comprises a compressed bundle 120 of a plurality of articles 122 of apparel, and at least one un-compressed article 110 of apparel. The compressed bundle is then wrapped in a shrink-wrap 145 or other suitable wrapping material. The un-compressed article 110 of apparel is placed relative to the compressed bundle 120 so that the un-compressed article 110 is predominantly visible. In the embodiment of FIG. 1, the un-compressed article 110 is placed on top of the compressed bundle 120.

A second embodiment is shown in FIG. 2. As shown in FIG. 2, this embodiment comprises a compressed bundle 220 of a plurality of articles 222, and also comprises at least one un-compressed article 210 of apparel. Again, the un-compressed article 210 of apparel is placed relative to the compressed bundle 220 so that the un-compressed article 210 is predominantly visible. In the embodiment of FIG. 2, however, the un-compressed article 210 is placed on top of the compressed bundle 220.

As shown in FIG. 3, and as explained in greater detail below, embodiment 300 comprises a compressed bundle 320 of a plurality of articles 322 of apparel, and at least one un-compressed article 310 of apparel. The un-compressed article 310 of apparel is placed relative to the compressed bundle 320 so that the un-compressed article 310 is predominantly visible. In the embodiment of FIG. 3, the un-compressed article 310 is wrapped substantially around the compressed bundle 320.

None of the embodiments 100, 200, or 300 are intended to limit the scope of the invention; rather, all packaging configurations comprising a plurality of compressed, or compacted, articles and at least one un-compressed bundle that is predominantly visible are within the scope of the invention.

Figure 4:
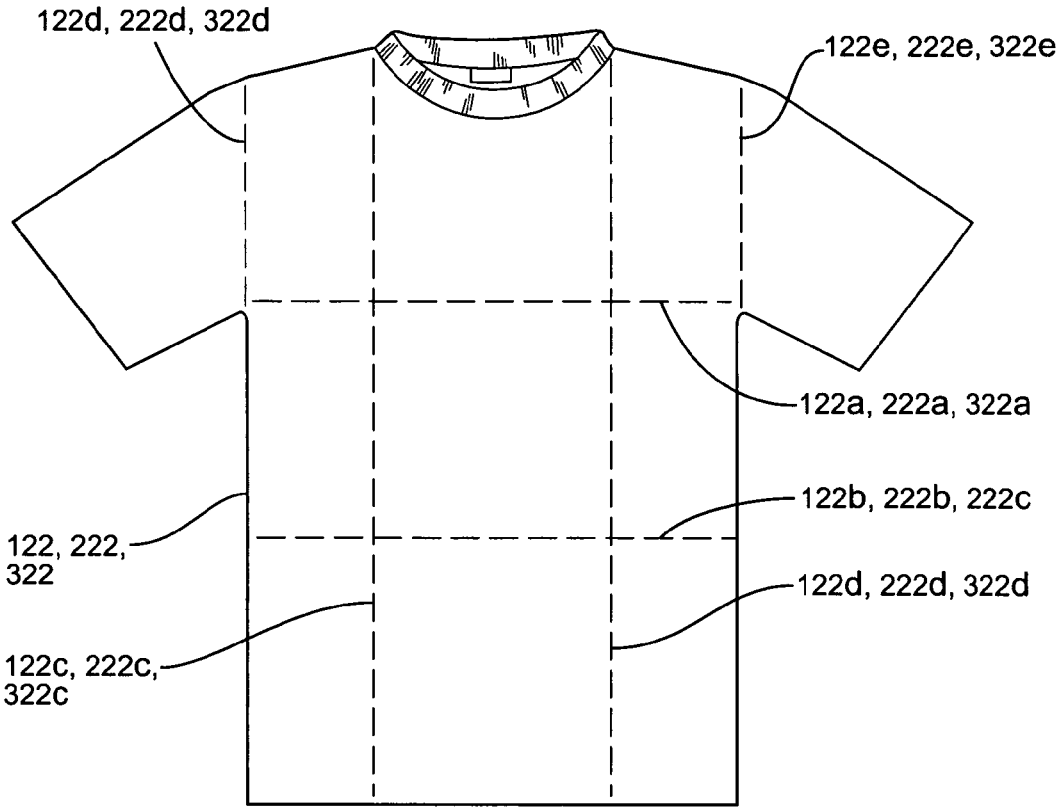
FIG. 4 is a front view illustrating the fold lines for an exemplary T-shirt.

As also will be described in greater detail below, various methods may be employed for constructing and forming the compressed, or compacted, bundle. In one method, the plurality of articles of apparel are folded in some manner and placed in a stack before being compressed. As shown in FIG. 4, an article of apparel such as a T-shirt 122, 222, 322 may first be folded to a desired shaped that will conform to the shape of the mold used to compress the bundle. By way of example, the T-shirts 122, 222, 333 may first be folded about fold lines 122*a*, 222*a*, 322*a* and 122*b*, 222*b*, 322*b*, and subsequently folded about fold lines 122*c*, 222*c*, 322*c* and 122*d*, 222*d*, 322*d*. The sleeve portions may also be folded inward along fold lines 122*e*, 222*e*, 322*e* and 122*f*, 222*f*, 322*f*. Alternatively, the T-shirts 122, 222, 322 may first be folded about fold lines 122*c*, 222*c*, 322*c* and 122*d*, 222*d*, 322*d*, and subsequently folded about fold lines 122*a*, 222*a*, 322*a* and 122*b*, 222*b*, 322*b*. The sleeve portions may also be folded inward along fold lines 122*e*, 222*e*, 322*e* and 122*f*, 222*f*, 322*f*.

Figure 5:
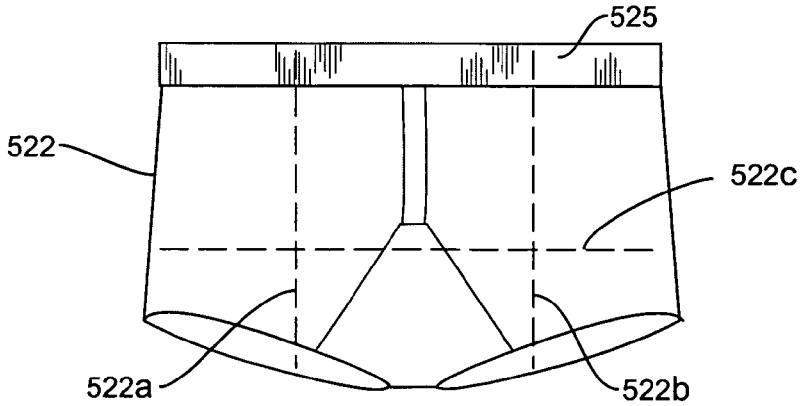
FIG. 5 is a front view illustrating the fold lines for an exemplary pair of briefs.

Referring to FIG. 5, briefs may be similarly folded about fold lines 522*a*, 522*b*, and 522*c* where a generally rectangular or square shape is desired.

Figure 6:
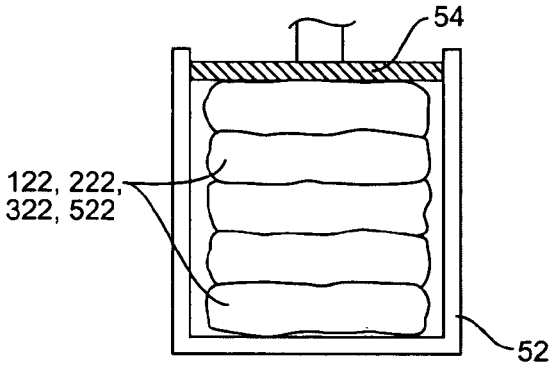
FIG. 6 is a cut-away side view of a mold cavity showing stacked apparel before being compressed.
Figure 7:
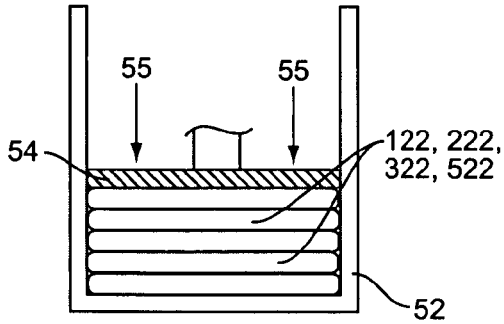
FIG. 7 is a cut-away side view of the mold cavity of FIG. 5 showing the compressed apparel.

Turning now to FIGS. 6 and 7, the compaction, or compression, method of the present invention is illustrated. As shown in FIG. 6, folded articles such as T-shirts 122, 222, 322, or underwear 522, are placed in a mold 52 having a desired shape. While the invention is not limited to a specific shape, a mold 52 cavity having a generally rectangular or square shape may be used for the compression of apparel. The folded articles 122, 222, 322, 522 of apparel in this example have previously been folded to a size that already generally conforms to the cross-sectional size of the mold 52 cavity. Once the desired number of articles 122, 222, 322, 522 have been placed in the mold in a stacked arrangement, the piston 54, or ram, of the compression apparatus is actuated to compress the articles into a compacted bundle. As will be appreciated in the art, the cross-section of the piston 54, or plunger, conforms in size and shape to the cross-section of the mold 52.

The inventors have found that the application of relatively high pressures achieves the desired compaction of multiple articles of apparel. FIG. 7 is exemplary of the mechanical compaction process whereby the piston 54 moves downwardly (illustrated by arrows 55), or the mold moves upwardly, to compact the stacked apparel. A pneumatic or hydraulically-powered apparatus may be used to operate the piston 54, the piston 54 being fitted with a shaped plunger that delivers the compacting, or compressing, force to apparel placed in the mold, cavity, or sleeve. Such powered devices are known in the art.

Specifically, for apparel such as T-shirts, briefs, and boxers, the present method requires that a compression pressure of at least about 3,000 pounds per square inch for between about 1 and 2 seconds be applied to the plurality of articles to form a substantially rigid bundle 120, 220, 320 that will retain its compressed shaped upon removal from the mold and will hold that shape through the packaging, storage, and retail display of the packaged apparel. For apparel such as socks, the present method requires that a compression pressure of at least about 2,000 pounds per square inch for between about 1 and 2 seconds. Because of the relatively high pressures involved in forming the rigid bundles 120, 220, the compressed articles are somewhat creased and wrinkled. Desirably, however, compression at these high pressures results in the volume of the compacted, or compressed, articles being between about 30 percent and 50 percent less than the volume of the un-compacted articles. It has been found that pressures as high as about 4,000 pounds per square inch can be applied without damaging compressed articles. Thus, in virtually all embodiments, because of the application of such relatively high pressures, the apparel comprising the bundle 120, 220, 320 must be laundered before wearing the apparel to return it to its original un-compacted condition by removing substantially any creases and wrinkles imparted by the compacting process.

Figure 8A:
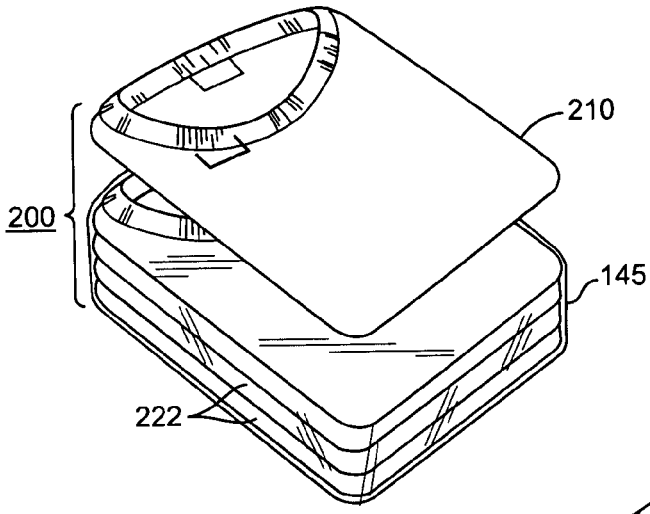
FIG. 8A is an exploded view of one embodiment of the present invention illustrating the placement of an un-compressed article of apparel, such as a T-shirt, relative to the compressed, shrink-wrapped, bundle of articles.
Figure 8B:
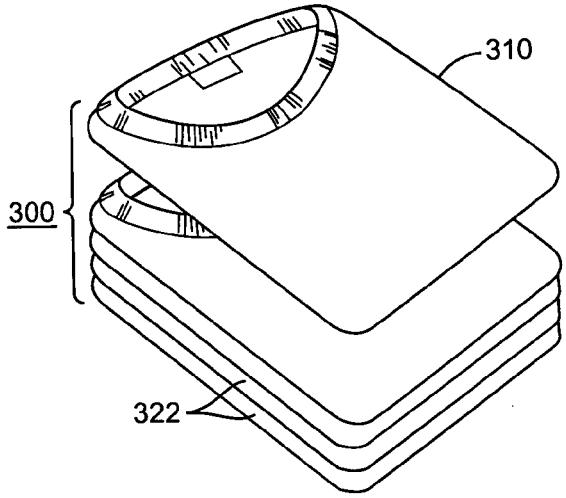
FIG. 8B is a perspective view of an alternative embodiment of the present invention illustrating the placement of an uncompressed article of apparel, such as a T-shirt, relative to the compressed bundle of articles.
Figure 8C:
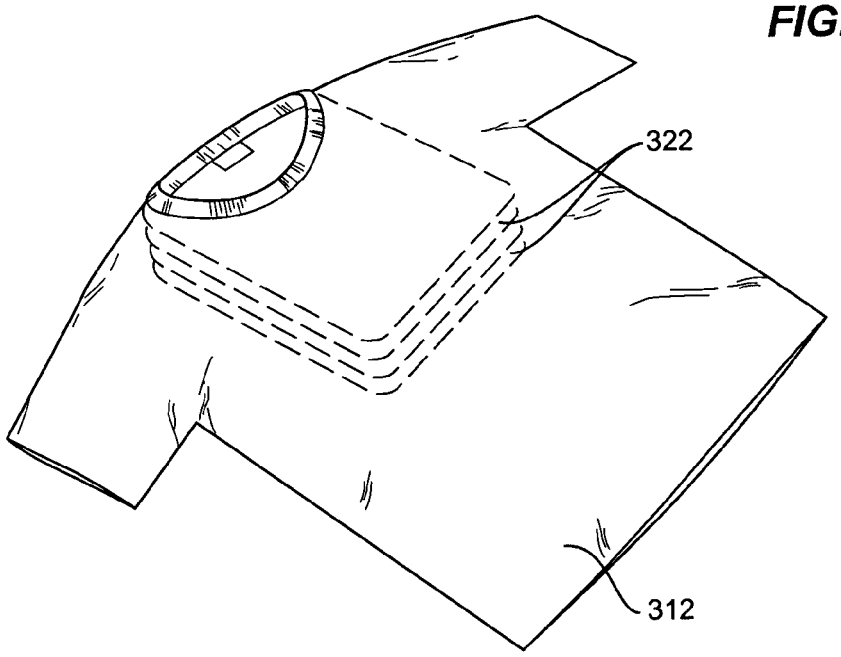
FIG. 8C is a perspective view illustrating the placement of an un-compressed article of apparel, such as a T-shirt, before being wrapped around the compressed bundle of articles.
Figure 10:
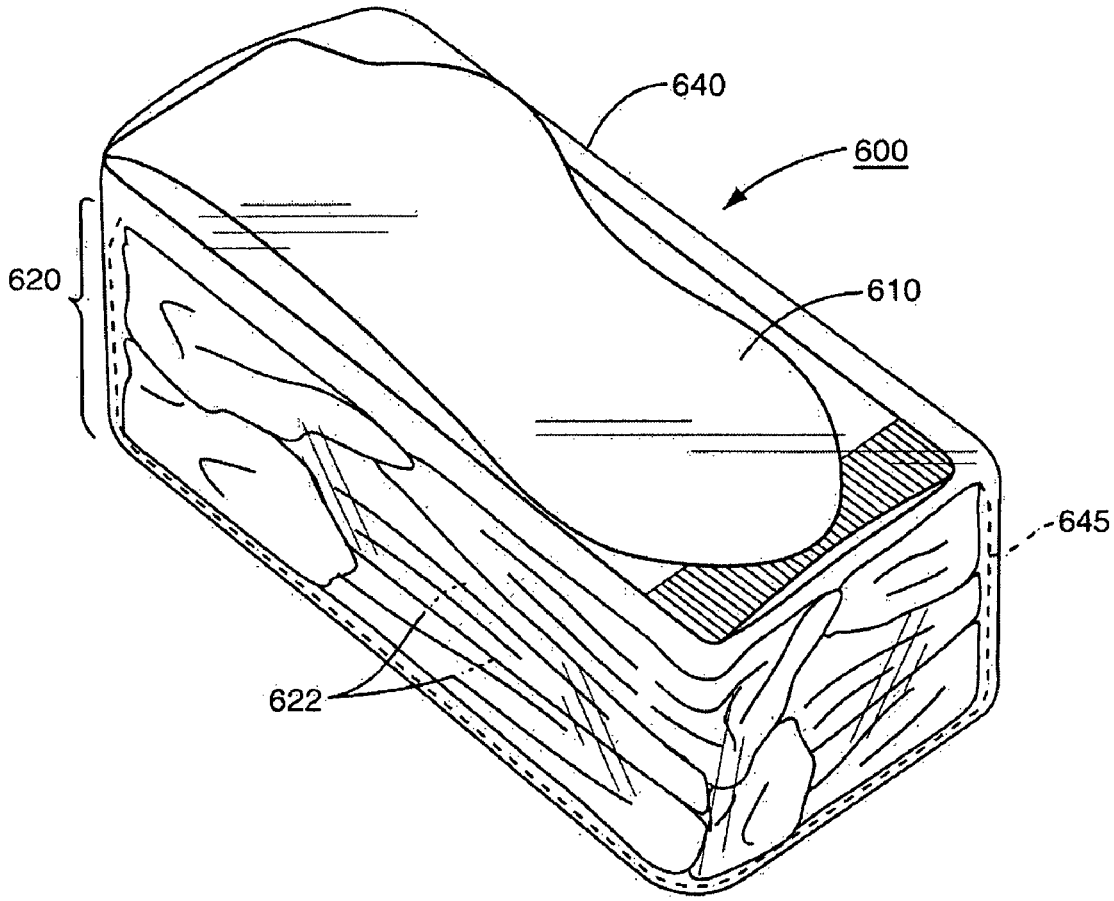
FIG. 10 is a top perspective view of an exemplary display package for socks.

Turning to FIGS. 8A through 8C, the construction of the packages 100, 200, and 300 is shown in greater detail. In the embodiment shown in FIGS. 1 and 8A, the compacted bundle 120 has been formed from folded and stacked apparel 122. Once the bundle 220 has been formed, the compacted bundle 120 is shrink-wrapped or wrapped in another suitable packaging material. Wrapping the compacted bundle 120 helps to prevent the inadvertent un-compacting of the apparel by a retail consumer who may happen to open the finished display package to view or touch the un-compressed article. Next, at least one un-compressed article 120 of apparel, such as a T-shirt, is folded and placed on top of the bundle 120. When so placed, the un-compressed article is predominantly visible to potential consumers. Thus, any creases and wrinkles present in the compacted bundle 120 are essentially hidden from view when the package 100 is displayed.

In the embodiment shown in FIGS. 2 and 8B, the compacted bundle 220 has been formed from folded and stacked apparel 222. Next, at least one un-compressed article 220 of apparel, such as a T-shirt, is folded and placed on top of the bundle 220. When so placed, the un-compressed article is again predominantly visible to potential consumers. Thus, any creases and wrinkles present in the compacted bundle 220 are essentially hidden from view when the package 200 is displayed.

Alternatively, as shown in FIGS. 3 and 8C, the un-compressed article 310 may be placed over the bundle 320 of articles 322 and then wrapped substantially around the entire bundle 320 so that the sides and ends of the bundle 320, and possibly the bottom of the bundle, may also be covered and not visible to a consumer upon inspection of the package. This manner of wrapping the bundle 320 may be desirable when the bundle 320 is formed of unfolded compressed articles of apparel.

Figure 9:
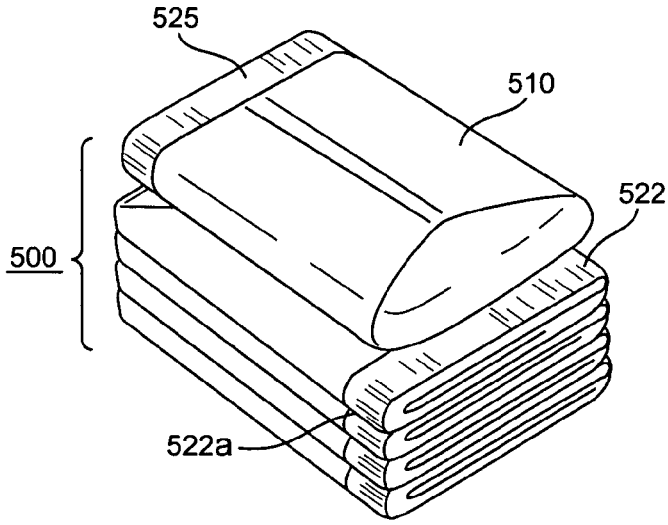
FIG. 9 is an exploded view of one embodiment of the present invention illustrating the placement of an un-compressed article of apparel, such as briefs, relative to the compressed bundle of articles.

Referring now to FIG. 9, a package construction for articles of apparel 522 such as boxers or briefs is shown. Because of the bulkier nature of waistbands 525 on these types of articles of apparel, the un-compressed article 510 may be placed relative to the bundle 520 so that the waistband 525 is at the opposite end of the package 500. While not required, this may facilitate a smoother, more uniform, and visually aesthetically pleasing package. Optionally, when a folded construction is desired, the placement of the individual articles 422 may be alternated when placed in the mold 52.

Figure 6A:
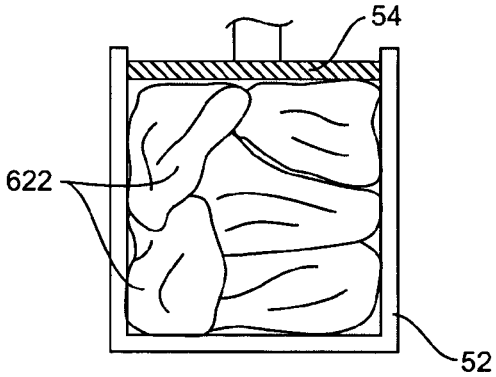
FIG. 6A is a cut-away side view of a mold cavity showing loosely packed apparel before being compressed.
Figure 7A:
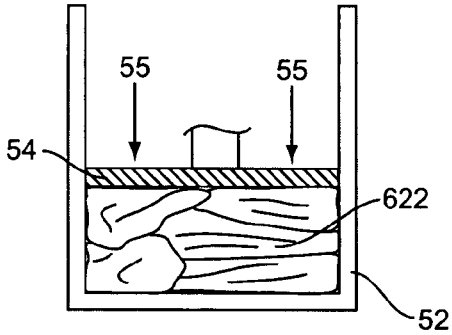
FIG. 7A is a cut-away side view of the mold cavity of FIG. 5A showing the compressed apparel.

As those skilled in the art will appreciate, when the articles of apparel are folded prior to the compression, or compaction, process, the manner of folding the articles of apparel 122, 222, 322, 522 is not key to the present invention; rather, any folding arrangement which results in the desired shape may be employed. Because the apparel must be laundered before it is worn, the apparel may be compacted without first being folded. Referring to FIGS. 6A and 7A, the articles of apparel 622, such as socks, may be loaded loosely, and randomly, into the mold 52. The piston 54 is then actuated to compress the articles 622 into a substantially rigid bundle similar in shape and dimension to the bundles shown in the Figures in general.

Although the package constructions shown in the Figures are illustrative of compacted bundles 120, 220, 320 of folded apparel, the method of constructing the packages 100, 200, and 300 described herein is equally applicable when the compacted bundles are formed as shown in FIGS. 6A and 7A.

Returning to the completed packages 100, 200, 300 shown FIGS. 1 through 3, once the uncompressed articles 110, 210, 310 are placed on or around the bundle 120, 220, 320, the compacted bundle 120, 220, 320 and the un-compacted article 110, 210, and 310 are packaged in a bag, or wrap, 140, 240, 340 so that the completed package 100, 200, 300 may be used to display the articles of apparel in a retail setting. A printed cardstock, paper, or polymeric label or tag 155, 255, 355 may be inserted between the un-compressed article and the shrink-wrap, or alternatively, the label or tag may be attached to the outside of the package or printed on the packaging material.

A second aspect of the present invention is directed to the method of packaging a plurality of articles of apparel. As shown in FIGS. 6, 6A, 7, and 7A, one or more articles of apparel are placed first in a mold having a desired shape. The one or more articles of apparel are then compacted by subjecting them to a predetermined pressure for a predetermined period of time to form a substantially rigid bundle that retains substantially the shape of the mold. The rigid bundle is then removed from the mold. The rigid bundle optionally may be shrink-wrapped. At least one un-compacted article then is positioned relative to the compacted bundle so that the un-compacted article of apparel is predominantly visible when packaged. Lastly, the compacted bundle and the un-compacted article are packaged in a suitable material such as shrink-wrap or poly-bag to form a single package. As described above, the compacted articles may be first folded prior to being compacted. Further, printed indicia, such as a tag or label, 155, 255, 355 may be placed in or on the package to indicate the type, size, etc. of the apparel.

Although the present invention has been described with exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

We claim:

1. A package containing a plurality of articles of apparel, comprising:

(a) a pressure compacted bundle having:

(i) a plurality of similar un-packaged compacted articles of apparel, each article having a compacted volume at least 30 percent less than the volume of a similar un-compacted article;

(ii) shrink-wrapping around the compacted bundle;

(b) at least one un-compacted article of similar apparel, each un-compacted article having a volume greater than the volume of each compacted article;

(c) the at least one un-compacted article being positioned on top of and in contact with the compacted bundle so that the at least one un-compacted article of apparel is visible when packaged; and (d) an outer wrapping enclosing the compacted bundle and the at least one un-compacted article of apparel.

2. The package of claim 1 wherein the at least one compacted article of apparel is folded.

3. The package of claim 1 wherein at least one un-compacted article of apparel is folded and positioned on top of the at least one compacted article of apparel.

4. The package of claim 1 wherein the at least one compacted article and the at least one un-compacted article are enclosed in shrink-wrapping.

5. The package of claim 1 wherein the outer wrapping comprises a bag for display of the compacted and un-compacted articles.

6. The package of claim 1 further including printed indicia to indicate the contents of the package.

7. The package of claim 1 wherein the compacted and un-compacted articles of apparel are selected from the group consisting of T-shirts and underwear.

* * * * *